United States Patent [19]

Pallmar

[11] Patent Number: 4,840,612

[45] Date of Patent: Jun. 20, 1989

[54] CENTRIFUGAL SEPARATOR AND METHOD OF OPERATING SAME

[75] Inventor: Anders Pallmar, Huddinge, Sweden

[73] Assignee: Alfa-Laval Marine and Power Engineering AB, Tumba, Sweden

[21] Appl. No.: 208,105

[22] Filed: Jun. 17, 1988

[30] Foreign Application Priority Data

Jun. 24, 1987 [SE] Sweden ..... 8702612

[51] Int. Cl.[4] ..... B04B 11/00

[52] U.S. Cl. ..... 494/2; 494/10; 494/48; 494/40; 494/70

[58] Field of Search ..... 494/1, 2, 3, 4, 10, 494/27, 40, 56, 48, 70, 74, 75; 210/360.1, 781, 782, 371

[56] References Cited

U.S. PATENT DOCUMENTS 3,642,196 2/1972 Nilsson ..... 494/2
4,343,431 8/1982 Wehling ..... 494/48 X
4,622,029 11/1986 Nilsson ..... 494/10 X
4,636,319 1/1987 Stroucken ..... 494/40
4,689,157 8/1987 Tenthoff ..... 210/371 X
4,784,635 11/1988 Bruning et al. ..... 494/74 X

*Primary Examiner*—Timothy F. Simone
*Attorney, Agent, or Firm*—Davis Hoxie Faithfull & Hapgood

[57] ABSTRACT

In a centrifugal separator, the rotor of which has a separation chamber (7) with an inlet (16) for a liquid mixture, a constantly open central outlet (23) for a separated liquid and an intermittently openable peripheral outlet (13) for separated solids, a so-called displacement liquid is supplied to the separation chamber (7) before the peripheral outlet (13) is opened first at a certain flow rate and then at a substantially lesser flow rate. If displacement liquid is sensed in the separated liquid leaving the rotor through the central outlet (23), the peripheral outlet (13) is opened.

9 Claims, 2 Drawing Sheets

CENTRIFUGAL SEPARATOR AND METHOD OF OPERATING SAME

Figure 1:
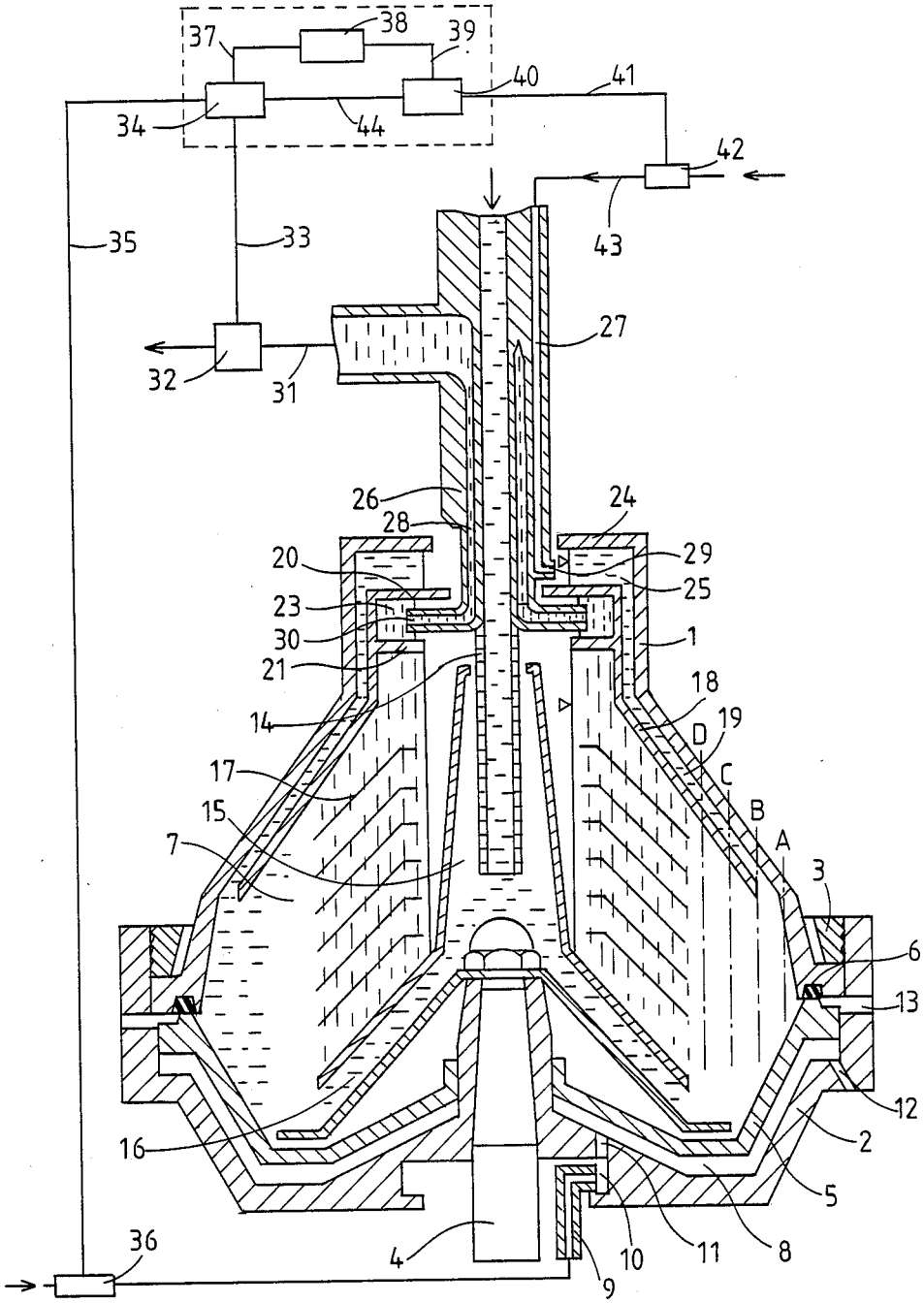

This invention relates to centrifugal separators and concerns particularly a method of operating a centrifugal separator with a rotor having a separation chamber, which chamber has an inlet for a liquid mixture, a central outlet for separated liquid and a peripheral outlet for separated solids, opening means for opening and closing the peripheral outlet during operation of the rotor, supply means supplying the separation chamber with a predetermined amount of displacement liquid that is heavier than said separated liquid, each time the peripheral outlet is to be opened, and control means for activating the supply means to supply displacement liquid immediately before the peripheral outlet is to be opened. The invention also concerns a centrifugal separator for performing said method.

In a centrifugal separator of the kind described , used in applications where the incoming liquid mixture contains, apart from solids, two kinds of liquids to be separated, the separation chamber has three separate outlets; two constantly opened outlets for the liquids and one intermittently openable for the solids. A centrifugal separator of this kind is described in U.S. Pat. No. 4,343,431. Lubricating oils, as an example, are usually purified by means of centrifugal separators of this kind.

A problem in connection with centrifugal separators of this kind is that they are sensitive to variations in temperature and flow rate of the supplied liquid feed mixture. Upon such variations an interface layer formed within the separation chamber between the separated liquids moves radially inwards or outwards, for which reason it is difficult to determine exactly its position in the separation chamber. Another problem is to make the right choice, for a centrifuge rotor of this kind, of the so-called gravity disk, the size of which determines the desired radial level for said interface layer. Changing the disk requires disassembling the rotor.

A centrifuge rotor with two constantly open liquid outlets has the further drawback that a large part of its separation chamber has to be filled with separated liquid, even if the content of this liquid in the supplied mixture is very small or sometimes even zero. This means that the separation chamber is used inefficiently.

In a centrifugal separator of this general class the separation chamber may alternatively have only two outlets; one constantly open outlet for separated, relatively light, liquid and one intermittently openable peripheral outlet for separated, relatively heavy solids. A centrifugal separator of this kind is used principally when a liquid is to be freed only from solids.

However, a centrifugal separator of this two outlet kind may be used even if the feed mixture contains two liquids in addition to solids. In a case like this separated, relatively heavy, liquid is removed intermittently from the rotor together with separated solids through the peripheral outlet of the separation chamber. In such cases the relatively heavy liquid usually constitutes only a small part of the supplied mixture.

A problem in using a centrifugal separator having only one central liquid outlet, when the supplied mixture contains two different kinds of liquids, is that the need for intermittent discharge of separated solids usually does not coincide in time with the need for intermittent discharge of separated, relatively heavy, liquid. This problem is particularly difficult to solve if the content of heavy liquid and solids, or either, in the feed varies. Further, it is difficult even in a centrifugal separator of this kind to determine exactly the radial position of the interface layer formed in the separation chamber between the separated liquids.

Regardless of whether a centrifugal separator has one or two constantly open liquid outlets, a so-called displacement liquid normally has to be supplied to the separation chamber just before each opening of the peripheral outlet for solids. The purpose of a supply of displacement liquid to decrease the amount of separated light liquid in the separation chamber so that no such light liquid leaves the separation chamber through the peripheral outlet when it is opened. If the heavier of the liquids to be separated is water, water is normally used as the displacement liquid.

In this connection it has proved difficult to supply the optimum amount of displacement liquid, because this depends upon the problem described above of safely determining the radial position of the interface layer in the separation chamber between the two separated liquids. It will thus be uncertain how much displacement liquid may be supplied without it beginning to leak out through the outlet for separated light liquid.

The object of the present invention is to provide a method by which this difficulty can be avoided, so that a centrifugal separator of the kind described may be used without risk of having an uncontrolled amount of displacement liquid flowing out through the outlet for the separated, relatively light, liquid.

This object is achieved by supplying a first part of the displacement liquid at a predetermined flow rate, after which a second part of the displacement liquid is supplied at a substantially smaller flow rate; detecting the presence of displacement liquid in the separated liquid leaving the rotor through the central outlet; and opening the peripheral outlet upon detecting displacement liquid in the separated liquid.

In this way it is possible, at each occasion when the peripheral outlet of the separation chamber is to be opened, to supply an optimum amount of displacement liquid to the separation chamber, a small and controlled amount thereof being allowed to flow out through the outlet for the separated, relatively light, liquid for determining the radial position in the separation chamber of the interface layer between displacement liquid and separated, relatively light, liquid.

The invention presumes that the separation chamber contains at least a certain known amount of separated, relatively light, liquid, i.e., that the separating operation is under sufficient control that an interface layer between the separated light liquid and a separated heavier component surely has not had time to move inside a certain radial level in the separation chamber. The invention thus presumes that during normal operation of the centrifugal separator the first part of the displacement liquid may be supplied relatively rapidly without risk of having a large part pass out through the outlet for the separated light liquid. Because part of the displacement liquid may be supplied relatively rapidly, i.e., with a relatively large flow rate, the time during which the separation chamber has to contain displacement liquid and therefore cannot be used effectively may be kept as short as possible. Because the second part of the displacement liquid is supplied substantially more slowly, i.e., with a substantially smaller flow rate, mixing of a large amount of displacement liquid with the separated the separated light liquid before appearance of displacement liquid in the discharging light liquid is sensed, may be prevented. It has been determined that even if detection of displacement liquid in the separated light liquid results in a very rapid opening of the peripheral outlet of the separation chamber, the content of displacement liquid in the separated light liquid which leaves the separation chamber immediately after such an opening operation, becomes unacceptably high, if the displacement liquid is supplied at a too large a flow rate over the entire course of its supply.

Preferably, according to the invention, the predetermined amount of displacement liquid is supplied batchwise and after the supply of one batch, the next batch is supplied only after the result of the preceding batch has been sensed in the separated liquid. It has been determined that when the interface layer between displacement liquid and separated light liquid has reached a certain critical radial level in the separation chamber, it still takes a certain time from the moment when a batch of displacement liquid has been supplied to the moment when displacement liquid is detected in the separated light liquid leaving the separation chamber. By batchwise supply of displacement liquid it is possible to avoid mixing an unnecessarily large amount of displacement liquid with separated light liquid accompanying it through the outlet. Preferably the first part of the displacement liquid is supplied substantially continuously in a relatively large batch, after which the rest is supplied in smaller batches or increments.

The invention will be further described in the following with reference to the accompanying drawings in which:

FIG. 1 shows a sectional view of a centrifuge rotor and, schematically, parts of the equipment for operation thereof in accordance with the invention.

Figure 2A:
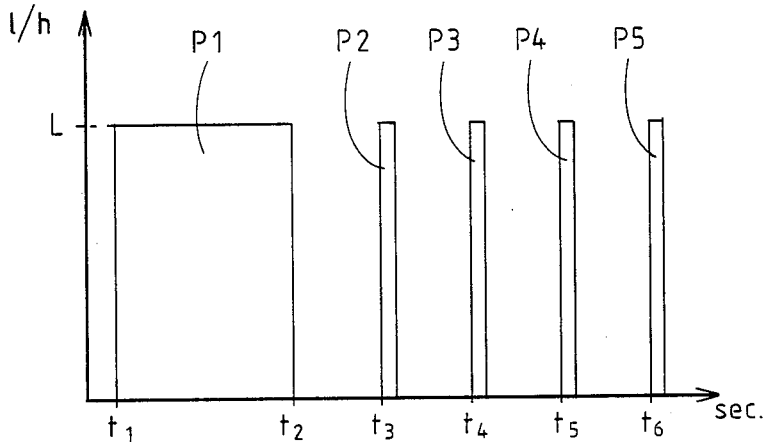
Figure 2B:
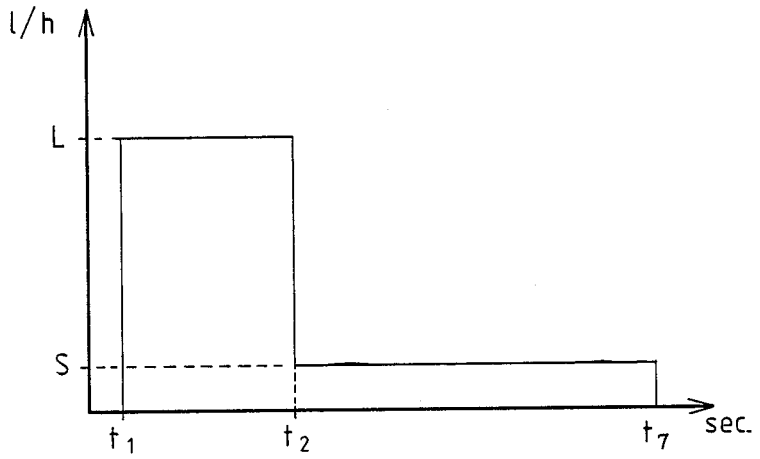

FIG. 2(*a*) and 2(*b*) are graphs illustrating two different methods of supplying displacement liquid according to the invention.

FIG. 1 shows a centrifugal separator comprising a rotor with an upper part 1 and a lower part 2, which parts are held together by means of a locking ring 3. The rotor is supported from below by a vertical drive shaft 4. Within the rotor there is an axially moveable slide 5, which in its upper position, shown in the drawing, abuts against an annular gasket 6 arranged in a groove in the upper rotor part 1. In this upper position the slide 5 with the upper rotor part 1 defines a separation chamber 7 within the rotor. Below the slide 5 and between it and the lower rotor part 2 is a so-called closing chamber 8 for a closing liquid furnished during operation of the rotor through a stationary pipe 9, a groove 10 and a channel 11 in the rotor part 2.

At the peripheral portion of the rotor the rotor part 2 has a throttled draining channel 12 extending from the closing chamber 8 to the outside of the rotor body.

During operation of the rotor enough closing liquid is constantly supplied to the closing chamber 8 so that the latter is kept filled. The slide 5 is therefore maintained in its upper position, as shown, in which it closes the separation chamber 7 from connection with a number of peripheral outlet ports 13. When desired, during operation of the rotor, the supply of closing liquid may be interrupted for a short time. Closing chamber 8 is then drained wholly or partly through the channel 12, upon which the slide 5 is pressed axially downwardly with reference to FIG. 1, so that the outlet ports 13 are uncovered.

For the supply of a liquid feed mixture of components to be separated a stationary inlet pipe 14 extends into the rotor to a central receiving chamber 15. From the receiving chamber 15 several channels 16 lead into separation chamber 7, in which a stack of frusto-conical separation discs 17 is arranged.

In the upper part of the separation chamber 7 a conical partition 8 is arranged, which together with the upper rotor part 1 forms a number of supply channels 19 for so-called displacement liquid. At its central portion the partition 18 has two inwardly directed and axially spaced annular flanges 20 and 21. Between these flanges a central outlet chamber 23 is formed in the rotor, which communicates with the separation chamber 7 through an overflow outlet formed by the radially innermost edge portion of the flange 21. Between the flange 20, which extends somewhat longer radially inwardly than the flange 21, and an upper end wall 24 of the rotor part 1 an inlet chamber 25 is formed for displacement liquid. This inlet chamber communicates with the previously mentioned supply channels 19.

The supply pipe 14 constitutes a part of a surrounding stationary member 26, which also forms an inlet channel 27 for displacement liquid and an outlet channel 28 for a light component of the supplied mixture separated in the rotor. The inlet channel 27 opens at 29 in the inlet chamber 25, and the outlet channel 28 starts at 30 in the outlet chamber 23.

During the operation of the rotor, free liquid surfaces are formed in the different chambers of the rotors at levels illustrated by means of triangles in FIG. 1. As can be seen, the part of the stationary member 26 forming the outlet channel 28 extends to a level radially outside of the free liquid surface in the outlet chamber 23.

The outlet channel 28 is connected to the interior of a conduit 31, in which a sensing device 32 is arranged. This sensing device 32 is arranged to detect fractions of displacement liquid accompanying separated light liquid out of the rotor. If the light liquid is constituted by oil and the displacement liquid by water, the sensing device 32 may be arranged to sense a change of the dielectric constant of the liquid leaving the rotor.

Through a signal line 33 the sensing equipment 32 is connected with an opening unit 34, which in turn, through a signal line 35, is connected with valve means 36 arranged to interrupt the supply of closing liquid to the closing chamber 8 in the rotor, so that its peripheral outlet 13 is opened. The sensing device 32 is arranged, immediately upon detecting a predetermined change of the dielectric constant of the liquid flowing through the conduit 31, to activate the opening unit 34 so that the peripheral outlet 13 of the rotor is opened during a short period of time.

The opening unit 34 also is connected through a signal line 37 with a control unit 38 arranged to activate the opening unit 34 at predetermined time intervals so that the peripheral outlet of the rotor is opened for a short period of time.

The control unit 38 is also connected through a signal line 39 to a supply unit 40, which in turn, through a signal line 41, is connected with valve means 42. Valve means 42 is situated in a conduit 43, the interior of which communicates with a pressure source of displacement liquid (not shown) and with the previously mentioned inlet channel 27. The control unit 38 is arranged to activate intermittently the supply unit 40 to supply displacement liquid to the rotor. Such activation occurs at a predetermined time in advance of each activation of opening unit 34 which is activated by the control unit 38. The supply unit 40 is adjustable for actuation of the valve 42 to supply displacement liquid to the rotor. According to the present invention the supply unit 40 should be adjusted in a way such that when it is activated by the control unit 38, it will first deliver a relatively large and then a relatively small flow of displacement liquid to the rotor. A signal line 44 connects the opening unit 34 with the supply unit 40, so that possibly current supply of displacement liquid may be interrupted by the supply unit 40 when the opening unit 34 accomplishes opening of the peripheral outlet 13 of the rotor.

FIG. 1 illustrates by means of dash-dot lines, A, B, C and D four different radial levels in the rotor separation chamber 7. These levels are referred to in the following description of the centrifugal separation operation.

FIG. 2, *a* and *b*, illustrate two of several possible methods of supply of displacement liquid within the scope of the present invention.

FIG. 2*a* illustrates the case where a relatively large portion, P1, of displacement liquid is supplied between two points of time $t_1$ and $t_2$ at a speed of L liters per hour, e.g., 60 l/h. During short time intervals thereafter smaller portions P2–P5 of displacement liquid are supplied at points of time $t_3$, $t_4$, $t_5$ and $t_6$. Each of the last mentioned time intervals, during which the portions P2–P5 are supplied, is very short, e.g. 5 seconds, whereas the periods of time between the points of time $t_2$ and $t_3$ and between subsequent portions P2–P5 preferably are somewhat longer, e.g., 30 seconds. The average flow rate at which displacement liquid is supplied during the time between the point of time $t_2$ and the point of time when the last portion P5 has been supplied, obviously is substantially smaller than L l/h.

FIG. 2 illustrates the case where displacement liquid is supplied between the points of time $t_1$ and $t_2$ at a rate of L l/h (the same as in FIG. 2*a*) and between the points of time $t_2$ and $t_7$ at a substantially smaller rate of S litres per hour.

The following discussion explains how the centrifugal separator according to FIG. 1 works when displacement liquid is supplied in the way illustrated in FIG. 2*a*. It is assumed that the liquid mixture to be treated is lubricating oil for a diesel motor, which oil is to be freed from solids and possibly water. As displacement liquid water is used.

During operating of the rotor, oil feed is supplied continuously through the inlet pipe 14, free liquid surfaces being maintained in the different chambers of the rotors as can be seen from FIG. 1. In connection with starting the separating operation a small amount of water is supplied through the inlet channel 27, the inlet chamber 25 and the supply channel 19, so that an interface layer between this water and the oil is formed in the separation chamber 7 at the radial level A. The reason for the supply of this small amount of water at the beginning of the operation derives from the experience that solids to be separated from the oil may more easily be removed from the separation chamber through the peripheral outlets 13, if they have been caused to pass through water. Such an initial supply of water is, however, not absolutely necessary.

After the separating operation has been going on for a period of time the length of which is predetermined and entered in the control unit 38, cleaned oil will continuously leave the separation chamber 7 through the overflow outlet formed by the flange 21. The cleaned oil leaves the rotor through the outlet chamber 23, the outlet channel 28 and the conduit 31. During this period of time an unknown amount of solids and an unknown amount of water is separated from the oil flowing through the separation chamber 7. It is assumed that at the end of the time period an interface layer between oil and water, or between oil and solids if no water has been supplied or separated from the oil, is situated at radial level B. At this moment the supply unit 40 is activated by the control unit 38 to start supplying displacement water. In accordance with FIG. 2*a* a relatively large portion P1 of displacement liquid is then supplied between the points of time $t_1$ and $t_2$ at a rate of L liters per hour. When the whole portion P1 has been supplied to the separation chamber 7 it is assumed that an interface between oil and water is situated at the level C. Still only cleaned oil flows out of the rotor and passes the sensing equipment 32.

Intermittently the separation chamber is then charged with four small portions P2–P5 of displacement water, according to FIG. 2*a*, after which the interface between lubricating oil and water in the separation chamber is assumed to have moved to the level D. It is assumed that sensing equipment 32 neither before nor after the point of time $t_6$ has sensed any change of the dielectric constant of the oil that has left the rotor. When a certain time has passed after $t_6$ the control unit 38 activates the opening unit 34, so that the latter accomplishes opening and closing of the peripheral outlet 13 of the rotor. The opening time is sufficiently long so that all separated solids and displacement water are thrown out of the separation chamber 7, but sufficiently short to prevent loss of oil. After this a new separation period is started, the length of which is determined by the control unit 38.

During the second separation period it is assumed that a somewhat larger amount of water and solids is separated from the oil flowing through the separation chamber 7 than during the first separation period. It is thus assumed that an interface between oil and water or solids is situated at the level C in the separation chamber 7 at the time $t_1$, i.e., when the first portion P1 of displacement water starts to be supplied to the rotor. After this portion P1 has entered the separation chamber, the interface layer is situated at the level D, and still only clean oil is sensed in the conduit 31.

Even after the portion P2 has been supplied to the rotor only clean oil is sensed in the conduit 31, but some seconds after the portion P3 has been supplied to the rotor, the sensing device 32 detects the existence of small quantities of water in the cleaned oil, since now the interface layer between separated oil and displacement water has reached a level radially very close to the outer edges of the separation discs 17 and fractions of displacement water are withdrawn by the oil flowing radially inwards between the separation discs. This immediately results in activation of the opening unit 34, so that the rotor peripheral outlet 13 is opened. Simultaneously a signal is given to the supply unit 40, so that further supply of displacement liquid is prevented. Thus portions P4 and P5 will not be supplied. The only amount of water which can accompany cleaned oil out of the rotor is therefore part of the portion P3.

It has been assumed above that displacement water has been supplied each time at the same rate, i.e., L liters per hour. To obtain good control of the exact amount of supplied displacement water the valve means 42 preferably is a so-called constant flow valve, i.e., a valve that in its open position always lets through liquid at a predetermined rate, independent of small variations in the pressure drop across the valve.

Within the scope of the invention it is of course possible to add the portion P1 at a certain rate (l/h) and each of the portions P2–P5 at a smaller rate.

According to a further aspect of the invention it is possible to automatically change the supply of displacement water in connection with a subsequent separation period, if displacement water is sensed in the cleaned oil. Thus, the control unit 38 may be arranged, in connection with the subsequent separation period, to adjust the supply unit to reduce the amount of displacement water in the first portion P1 and, instead, to increase the number of small portions, to, for instance, five or six. The current total amount of supplied displacement water should not be changed. Thus a rapid adaptation to a gradual or unexpectedly large increase of the amount of water or solids in the oil may be accomplished, so that there will not be too large an amount of displacement water mixed with cleaned oil. If upon a subsequent period of supply of displacement water no water is sensed in the cleaned oil, the control unit 38 may be arranged to cause the supply unit 40 again to supply displacement water in the original way.

The control unit 38 also may contain alarm means, which in one way or another makes an operator aware of the fact that the sensing device 32 during subsequent separation periods is forced to initiate opening of the rotor periphery outlet as a consequence of sensed displacement water in the cleaned oil. This may for instance indicate that a water leakage has come up in the diesel motor through which the lubricating oil is circulating. The sensing device preferably is arranged to initiate opening of the rotor periphery outlet 13 upon sensing of water in the cleaned oil, even if this happens before displacement water is supplied at the end of a separation period.

In the above description reference has been made to an opening unit, supply unit and control unit. However, there do not have to be separate "units" for the functions in question. In practice the three units will be integrated in one single central unit for all functions.

What is claimed is:

1. In the operation of a centrifugal separator having a rotor, a separation chamber in said rotor, said chamber having an inlet for liquid feed mixture, a central outlet for separated liquid and a peripheral outlet for separated solids, opening means for opening and closing the peripheral outlet during operation of the rotor, means for supplying a predetermined amount of a displacement liquid heavier than said separated liquid to the separation chamber and control means for activating said supply means to supply displacement liquid to said separation chamber immediately prior to the opening of said peripheral outlet, the improvement which comprises:

a. supplying a first quantity of displacement liquid to said separation chamber at a first flow rate and then supplying a second quantity at a substantially lower rate;

b. detecting the possible existence of displacement liquid in the separated liquid leaving the rotor through the central outlet; and c. opening the peripheral outlet in response to the detection of displacement liquid in the separated liquid.

2. The method claimed in claim 1, and comprising supplying the displacement liquid batch-wise and supplying a subsequent batch only when the effect of the previous batch has been sensed in the separated liquid.

3. The method claimed in claim 1 or 2 and comprising supplying the first part of the displacement liquid substantially continuously, and the balance in smaller increments.

4. The method claimed in claim 1 and comprising reducing the size of the first quantity of displacement liquid in response to the presence of displacement liquid in the separated liquid.

5. The method according to claim 1 and comprising interrupting the supply of the predetermined amount of displacement liquid upon detection of displacement liquid in the separated liquid.

6. The method claimed in claim 1 and comprising opening the peripheral outlet after the predetermined amount of displacement liquid has been supplied, independent of the detection of displacement liquid in the separated liquid.

7. In a centrifugal separator comprising a rotor having a separation chamber, said chamber having an inlet for a liquid mixture, a central outlet for a separated liquid and a peripheral outlet for separated solids, opening means for opening and closing the peripheral outlet during operation of the rotor, supply means for supplying a predetermined amount of displacement liquid heavier than said separated liquid to the separation chamber, control means arranged to activate said supply means to supply displacement liquid immediately prior to opening the peripheral outlet, the improvement which comprises means for regulating said supply means to supply displacement liquid at a predetermined initial flow rate and after that at a substantially lower flow rate; a sensing means for detecting the existence of displacement liquid in separated liquid leaving the rotor through the central outlet and means connected with said opening means and said sensing means and arranged to open the peripheral outlet upon the detection displacement liquid in the separated liquid.

8. Centrifugal separator according to claim 7 and in which the supply means supplies the displacement liquid in an initial large batch and then, at predetermined time intervals, in smaller batches.

9. Centrifugal separator according to claim 7 and in which the supply means is connected to the sensing means and arranged to interrupt the supply of displacement liquid when displacement liquid is detected in the separated liquid.

* * * * *

UNITED STATES PATENT AND TRADEMARK OFFICE

CERTIFICATE OF CORRECTION

PATENT NO. : 4,840,612

DATED : June 20, 1989

INVENTOR(S) : Anders Palimar

It is certified that error appears in the above-identified patent and that said Letters Patent is hereby corrected as shown below:

Col. 8, line 48 at the end of the line, insert --of--
Col. 8, line 51, cancel "supplies" and insert --is arranged to supply--

Signed and Sealed this

Sixth Day of November, 1990

*Attest:*

HARRY F. MANBECK, JR.

*Attesting Officer*

*Commissioner of Patents and Trademarks*